US010533147B2

(12) United States Patent
Lundberg et al.

(10) Patent No.: US 10,533,147 B2
(45) Date of Patent: Jan. 14, 2020

(54) SOIL RELEASE POLYMER IN A SOLID SOUR

(71) Applicant: Ecolab USA Inc., Saint Paul, MN (US)

(72) Inventors: Steven Lundberg, Apple Valley, MN (US); Jonathan P. Fast, St. Paul, MN (US); Robert D. P. Hei, Baldwin, WI (US)

(73) Assignee: Ecolab USA Inc., Saint Paul, MN (US)

( * ) Notice: Subject to any disclaimer, the term of this patent is extended or adjusted under 35 U.S.C. 154(b) by 181 days.

(21) Appl. No.: 14/273,936

(22) Filed: May 9, 2014

(65) Prior Publication Data

US 2015/0322381 A1 Nov. 12, 2015

(51) Int. Cl.

| | |
|---|---|
| ***C11D 17/00*** | (2006.01) |
| ***C11D 13/16*** | (2006.01) |
| ***C11D 1/75*** | (2006.01) |
| ***C11D 1/62*** | (2006.01) |

(52) U.S. Cl.
CPC ..... *C11D 17/0052* (2013.01)

(58) Field of Classification Search
CPC . C11D 17/0052; C11D 3/2715; D06M 13/325
USPC ..... 8/115.51; 510/141
See application file for complete search history.

(56) References Cited

U.S. PATENT DOCUMENTS

| | | | | |
|---|---|---|---|---|
| 3,782,898 | A | 1/1974 | Mandell, Jr. | |
| 3,893,929 | A | 7/1975 | Basadur | |
| 4,057,503 | A | 11/1977 | Graver et al. | |
| 4,108,780 | A | 8/1978 | Thomas | |
| 4,769,159 | A | 9/1988 | Copeland | |
| 5,179,168 | A * | 1/1993 | Hirasawa | C08L 23/0853 525/221 |
| 5,880,076 | A * | 3/1999 | Vermeer | A61K 8/42 510/119 |
| 6,110,886 | A * | 8/2000 | Scepanski | C11D 1/835 510/287 |
| 6,200,351 | B1 | 3/2001 | Schleinig et al. | |
| 8,580,549 | B2 * | 11/2013 | Michels | C12N 9/18 435/19 |
| 2002/0002129 | A1 * | 1/2002 | Scepanski | C11D 3/395 510/446 |
| 2004/0053808 | A1 * | 3/2004 | Raehse | C11D 17/0039 510/447 |
| 2005/0020476 | A1 * | 1/2005 | Wahl | C11D 3/001 510/515 |
| 2008/0005852 | A1 * | 1/2008 | Hu et al. | 8/115.51 |
| 2008/0214425 | A1 | 9/2008 | Lant et al. | |
| 2010/0229313 | A1 | 9/2010 | de Buzzaccarini et al. | |
| 2012/0324652 | A1 * | 12/2012 | Christensen | C11D 1/62 8/137 |
| 2013/0111675 | A1 | 5/2013 | Soontravanich et al. | |
| 2013/0225475 | A1 | 8/2013 | Truong et al. | |
| 2015/0322381 | A1 * | 11/2015 | Lundberg | C11D 3/0036 8/137 |

FOREIGN PATENT DOCUMENTS

| | | | | |
|---|---|---|---|---|
| WO | WO-2008084459 | A1 * | 7/2008 | C11D 1/667 |
| WO | WO 2010124823 | A1 * | 11/2010 | C11D 1/65 |
| WO | 2013185346 | | 12/2013 | |

OTHER PUBLICATIONS

HOOPAD Chemical Group definition of TEXCARE SRN 240, 2014.*

IHC NEW, Public, Functional Chemicals, "The TexCare SRN line", The Clariant Newsletter on Industrial & Home Care, Issue 6, Jul. 2009.

Clariant, FUN Divisiona, Industrial and Home Care, "TexCare SRN Grades Let them do the Laundry for you", 2010.

* cited by examiner

*Primary Examiner* — Gregory R Delcotto
*Assistant Examiner* — Preeti Kumar
(74) *Attorney, Agent, or Firm* — McKee, Voorhees & Sease, PLC

(57) ABSTRACT

Applicants have developed a physically and chemically stable solid composition containing a soil release polymer and an acidulant. The sour step thus accomplishes both stain removal and residual alkalinity removal. A novel method of using a soil release polymer and an acidulant together in the same post wash step of a laundry wash process is also disclosed. The solid composition is physically stable, even during aqueous dispensing, i.e. non-slumping and non-weeping. The solid could be formed through a melt, cast, or pressed process.

9 Claims, No Drawings

SOIL RELEASE POLYMER IN A SOLID SOUR

FIELD OF THE INVENTION

The present invention relates to solid sour compositions for oily soil release from synthetic fabrics as well as neutralization of residual alkalinity in a final rinse step of the wash process. Solid treatment compositions and methods of use are disclosed as well as methods of manufacturing of the same.

BACKGROUND OF THE INVENTION

In typical commercial or industrial laundry processes, textile materials such as sheets, towels, wipes, garments, tablecloths, etc. are commonly laundered at elevated temperatures with alkaline detergent materials. Such detergent materials typically contain a source of alkalinity such as an alkali metal hydroxide, alkali metal silicate, alkali metal carbonate or other such base component. When the fabric is treated with an alkaline detergent composition a certain amount of carryover alkalinity may occur. Carryover alkalinity refers to the chemistry that is contained within the fabric (that has not been completely removed) that is available for the next step. For example, when the detergent use solution provides an alkaline environment, it is expected that the detergent use solution will provide a certain amount of carryover alkalinity for a subsequent sour treatment step unless all of the detergent use solution is removed by rinsing.

The residual components of the alkaline detergents remaining in or on the laundered item can result in fabric damage and skin irritation by the wearer of the washed fabric. This is particularly a problem with towels, sheets and garments. Sour materials contain acid components that neutralize alkaline residues on the fabric.

Another ongoing problem in the laundering field is the removal soil and/or oily stains from synthetic fabrics. Synthetic fibers, (fabrics having synthetic fibers incorporated therein or made entirely of synthetic fibers), are hydrophobic and oleophilic. As such the oleophilic characteristics of the fiber permit oil and grime to be readily embedded in the fiber, and the hydrophobic properties of the fiber prevent water from entering the fiber to remove the contaminants from the fiber.

The removal of oily stains, especially on polyester has not been successfully addressed. Several solutions have been proposed using soil release polymers. Soil release polymers are widely known to be effective at aiding the removal of oily soils from synthetic fabrics in a laundry wash process. The polymers work by having both hydrophobic and hydrophilic blocks that allow them to adhere to the polyester surface and make it more hydrophilic. By making the surface more hydrophilic the affinity of oily soils, like dirty motor oil, with polyester is reduced which makes the soil easier to remove. This effect is greater when soil release polymers are used over multiple wash cycles, as the polymers are known to buildup on the fabric.

The main wash step of a typical institutional or industrial laundry cycle has a use solution with both high surfactant and high alkalinity (~pH 11 or higher). Conversely, the final rinse step wash liquor is less reactive as the pH is near neutral and any surfactant has been rinsed away. Therefore, it is desirable to use a soil release polymer in the final rinse step. Unfortunately this class of polymer is not stable in a liquid sour because they are polyester based and react with the acid or oxidizer.

WO96/24657 discloses high alkalinity detergent composition comprising non-ionic surfactant and a soil release polymer. The composition is in powder form and it is delivered into the main wash of an institutional textile washing process. U.S. Pat. No. 6,200,351 relates to an institutional textile washing process in which a soil release polymer is used in a separate pre-treatment step.

As can be seen, there is a continuing need in the art for the development laundry sour treatments after alkaline washing that remove residual caustic, but also that are environmentally friendly and sustainable.

It is an object of the present invention to provide a solid composition used as a post wash laundering step that includes not only a sour component to treat and remove carryover alkalinity, but also includes a stain removal component to provide a mechanism for further oily stain removal, particularly from polyester or other synthetic fabrics.

Other objects, aspects and advantages of this invention will be apparent to one skilled in the art in view of the following disclosure, the drawings, and the appended claims.

SUMMARY OF THE INVENTION

Applicants have developed a physically and chemically stable, i.e. non-hydrolyzing, solid composition containing a soil release polymer and an acidulant. Typically, soil release polymers were expected to be too unstable to form a suitable solid formulation, in combination with an acidulant. The novel sour composition of the invention can thus accomplish both stain removal and residual alkalinity removal.

A novel method of using a soil release polymer and an acidulant together in the same post wash step of a laundry wash process is disclosed. In fact, applicants surprisingly found that soil release polymers clean synthetic fabrics better after the wash step than when used before or during the alkalinity wash step. The invention also includes a process of preparing a solid composition with a soil release polymer and acidulant that is physically stable, even during aqueous dispensing, i.e. non-slumping and non-weeping. The solid could be formed through a melt, cast, or pressed process.

The laundry sour compositions and processes of the invention make use of a solid fabric laundry sour that is used following cleaning with alkaline detergent, particularly on synthetic fabrics. In one process of the invention, the fabric items can be contacted with an alkaline detergent material for the purpose of loosening and removing soil from the fabric to produce a treated item. The treated items are then subsequently contacted with a use solution of the solid sour composition of the invention.

The solid sour composition includes from about 10 wt. % to about 90 wt. % of an acid source which can be organic or inorganic, and from about 0.01 wt. % to about 10 wt. % of a soil release polymer. In some embodiments the composition can include one or more solidification aides, a fabric softener component, bleaching aids and the like. Additional components such as chelators, oxidizers, fragrances and other typical components of laundry detergents/pretreatments/sours such as surfactants etc. may also be present. The souring operation is accomplished at a pH within the range of about 4 to 6.5 and the amount of sour required will depend on the extent of residual alkalinity carried over in the fabrics from the alkaline detergent washing cycle.

In yet another embodiment, a method of making solid sour composition is disclosed. The process can include the steps of: (a) adding a proper amount of solidification aid to a mixture of an acid source and a soil release polymer and (b) forming a solid from the above mixture so that a stable non-weeping solid is formed.

The solid is then diluted to form a use composition. Dilution ratios can be between about 1:10 and about 1:10,000 to form a use solution. The use solution is then contacted with a textile article to be cleaned.

The invention also includes methods for a fabric cleaning process, substantially free of phosphorus that can clean and neutralize fabric, particularly synthetic fabrics. This process includes contacting a soiled fabric item with an aqueous alkaline detergent to remove soil and produce a treated fabric item, and subsequently contacting the treated fabric item with the use composition generated from the solid sour composition of the invention.

Any fabric textile may be treated according to the invention, (synthetic, blended or natural) although as indicated the sour composition is particularly suited for treating and removing oily stains from synthetic textiles. Examples of synthetic textiles include polyester, polyamide, polyacrylonitrile, polyacryl, polyisoprene or polyurethane. Preferred synthetic textile fabric is polyester or polyamide, more preferred is polyester. A blended textile is synthetic and/or natural. Natural textiles include vegetable fibres such as cotton, viscose, flax, rayon or textile, preferably cotton and animal fibres such as wool, mohair, cashmere, angora and silk, preferably wool. Preferred synthetic blended textile is blended polyester or polyamide, more preferred is polyester. Preferred blended polyester is polyester/cotton and polyester/polyamide. Preferably, the ratio by weight of synthetic to natural fabric, especially polyester to cotton, in a blended in a blended textile is 80:20 to 20:80, more preferably 70:30 to 30:70.

DETAILED DESCRIPTION OF THE INVENTION

So that the invention maybe more readily understood, certain terms are first defined and certain test methods are described.

As used herein, "weight percent," "wt-%," "percent by weight," "% by weight," and variations thereof refer to the concentration of a substance as the weight of that substance divided by the total weight of the composition and multiplied by 100. It is understood that, as used here, "percent," "%," and the like are intended to be synonymous with "weight percent," "wt-%," etc.

It should be noted that, as used in this specification and the appended claims, the singular forms "a," "an," and "the" include plural referents unless the content clearly dictates otherwise. Thus, for example, reference to a composition containing "a compound" includes a composition having two or more compounds. It should also be noted that the term "or" is generally employed in its sense including "and/or" unless the content clearly dictates otherwise.

As used herein, the term "phosphate-free" refers to a composition, mixture, or ingredient that does not contain a phosphate or phosphate-containing compound or to which a phosphate or phosphate-containing compound has not been intentionally added. Should a phosphate or phosphate-containing compound be present through contamination of a phosphate-free composition, mixture, or ingredients, the amount of phosphate shall be less than 0.5 wt-%. More preferably, the amount of phosphate is less than 0.1 wt-%, and most preferably, the amount of phosphate is less than 0.01 wt-%.

As used herein, the term "phosphorus-free" refers to a composition, mixture, or ingredient that does not contain phosphorus or a phosphorus-containing compound or to which phosphorus or a phosphorus-containing compound has not been intentionally added. Should phosphorus or a phosphorus-containing compound be present through contamination of a phosphorus-free composition, mixture, or ingredients, the amount of phosphorus shall be less than 0.5 wt-%. More preferably, the amount of phosphorus is less than 0.1 wt-%, and most preferably the amount of phosphorus is less than 0.01 wt-%.

"Cleaning" means to perform or aid in soil removal, bleaching, microbial population reduction, rinsing, or combination thereof.

As used herein, the term "fabric treatment composition" includes, unless otherwise indicated, fabric softening compositions, fabric enhancing compositions, fabric freshening compositions and combinations thereof. Such compositions may be, but need not be rinse added compositions.

The term "fabric" or "textile" refers to items or articles that are cleaned in a laundry washing machine. In general, "textile" refers to any item or article made from or including textile materials, woven fabrics, non-woven fabrics, and knitted fabrics. The textile materials can include natural or synthetic fibers such as silk fibers, textile fibers, cotton fibers, polyester fibers, polyamide fibers such as nylon, acrylic fibers, acetate fibers, and blends thereof including cotton and polyester blends. The fibers can be treated or untreated. Exemplary treated fibers include those treated for flame retardancy.

The term "about," as used herein, modifying the quantity of an ingredient in the compositions of the invention or employed in the methods of the invention refers to variation in the numerical quantity that can occur, for example, through typical measuring and liquid handling procedures used for making concentrates or use solutions; through inadvertent error in these procedures; through differences in the manufacture, source, or purity of the ingredients employed to make the compositions or carry out the methods; and the like. The term "about" also encompasses amounts that differ due to different equilibrium conditions for a composition resulting from a particular initial mixture. Whether or not modified by the term "about," the claims include equivalents to the quantities. All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure.

The recitation of numerical ranges by endpoints includes all numbers subsumed within that range (e.g. 1 to 5 includes 1, 1.5, 2, 2.75, 3, 3.80, 4, and 5).

As used herein, a "solid sour composition" refers to a composition in the form of a solid such as an agglomerate, a flake, a granule, a pellet, a tablet, a lozenge, a puck, a briquette, a brick, a solid block, a unit dose, or another solid form known to those of skill in the art. The term "solid" refers to the state of the composition under the expected conditions of storage and use of the solid composition. In general, it is expected that the composition will remain in solid form when exposed to temperatures of 38° C. and preferably 49° C. A cast, pressed, or extruded "solid" may take any form including a block. When referring to a cast, pressed, or extruded solid it is meant that the hardened composition will not flow perceptibly and will substantially retain its shape under moderate stress or pressure or mere gravity, as for example, the shape of a mold when removed from the mold, the shape of an article as formed upon extrusion from an extruder, and the like. The degree of hardness of the solid cast composition can range from that of a fused solid block, which is relatively dense and hard, for example, like concrete, to a consistency characterized as being malleable and sponge-like, similar to caulking material.

Solid Sour Composition

The solid sour compositions and processes of the invention provide for the use of soil release polymers and acidulants for residual alkalinity removal combined with oily soil removal in a post wash treatment. The sour composition helps to neutralize remaining alkalis and also helps to remove soil, particularly from synthetic fabrics. In the processes of the invention, the fabric items can be contacted with an alkaline detergent material for the purpose of loosening and removing soil from the fabric to produce a treated item. The treated items are then subsequently contacted with the sour treatment composition of the invention.

The composition of the invention includes an acid source (organic or inorganic, preferably organic) and a soil release polymer in a solid form. The sour composition as a use solution has a pH of 4 to about 7, and serves to neutralize any remaining alkalis and also is particularly suited for removing oily soils from the fabrics and system.

The solid sour composition includes from about 30 wt. % to about 90 wt. % of an acid source which can be organic or inorganic, and from about 0.01 wt. % to about 10 wt. % of a soil release polymer. In some embodiments the composition can include one or more solidification aides, a fabric softener component, bleaching aids and the like. Additional components such as chelators, oxidizers, fragrances and other typical components of laundry detergents/pretreatments/sours such as surfactants etc. may also be present. The souring operation is accomplished at a pH within the range of about 4 to 6.5 and the amount of sour required will depend on the extent of residual alkalinity carried over in the fabrics from the alkaline detergent washing cycle.

In yet another embodiment, a method of making the solid sour composition is disclosed. The acid source and soil release polymer are mixed to form a composition which is then solidified. The cleaning composition may then be diluted to form a use composition. Dilution ratios can be between about 1:10 and about 1:10,000 to form a use solution. The use solution is then contacted with a textile article to be cleaned.

The laundry sour/stain pretreatment compositions may be a solid block, cast solid block, pressed solid block, or extruded block such that the composition if non-flowing at room temperature. Solid block and cast solid block materials can be made by introducing into a container either a prehardened block of material or a castable liquid that hardens into a solid block within the container.

The compositions may be provided in bulk or in unit dose. For example, the compositions may be provided in a large solid block that may be used for many cleaning cycles. Alternatively, the compositions may be provided in unit dose form wherein a new composition is provided for each new cleaning cycle.

The compositions may be packaged in a variety of materials including a water soluble film, disposable plastic container, flexible bag, shrink wrap, and the like. Further, the compositions may be packaged in such a way as to allow for multiple forms of product in one package, for example, a liquid and a solid in one unit dose package.

The alkaline detergent and textile sour treatment composition may be either provided or packaged separately or together. For example, the alkaline detergent composition may be provided and packaged completely separate from the sour composition. Alternatively, the alkaline detergent and treatment compositions may be provided together in one package. For example, the alkaline detergent and textile solid sour may be provided in a layered block or tablet wherein the first layer is the alkaline detergent composition, and the second layer is the solid sour composition. It is understood that this layered arrangement may be adjusted to provide for more steps as contemplated by the invention or to include additional washes or rinses. The individual layers preferably have different characteristics that allow them to dissolve at the appropriate time. For example, the individual layers may dissolve at different temperatures that correspond to different wash cycles; the layers may take a certain amount of time to dissolve so that they dissolve at the appropriate time during the wash cycle; or the layers may be divided by a physical barrier that allows them to dissolve at the appropriate time, such as a paraffin layer, a water soluble film, or a chemical coating.

In addition to providing the alkaline detergent and solid sour compositions in layers, the compositions may also be in separate domains, for example, wherein each domain is dissolved by a separate spray when the particular composition is desired.

Compositions of the Invention

Acid Source/Acidulant

The solid sour composition of the present invention includes at least one acid source including an organic or inorganic acid. The acids preferably do not include phosphates or silicates and the composition is preferably substantially free of the same. Both organic and inorganic acids have been found to be generally useful in the present composition. Examples of suitable organic acids include carboxylic acids such as but not limited to hydroxyacetic (glycolic) acid, citric acid, formic acid, acetic acid, propionic acid, butyric acid, valeric acid, caproic acid, trichloroacetic acid, urea hydrochloride, and benzoic acid, among others. Organic dicarboxylic acids such as oxalic acid, malonic acid, gluconic acid, itaconic acid, succinic acid, glutaric acid, maleic acid, fumaric acid, adipic acid, and terephthalic acid among others are also useful in accordance with the invention. Any combination of these organic acids may also be used intermixed or with other organic acids which allow adequate formation of the composition of the invention.

Inorganic acids useful in accordance with the invention include sulfuric acid, sulfamic acid, methylsulfamic acid, hydrochloric acid, hydrobromic acid, and nitric acid among others. These acids may also be used in combination with other inorganic acids or with those organic acids mentioned above. In a preferred embodiment, the composition is substantially free of inorganic acids.

In one embodiment, the acid (organic or inorganic) preferably comprises in the range from about 10 to about 99 wt. % of the total solid sour composition, preferably in the range from about 15 to about 95 wt. % of the total solid sour composition, and more preferably in the range from about 20 to about 90 wt. % of the total textile treatment composition.

Soil Release Polymer

Soil release polymers enhance the laundry cleaning efficacy by improving release of grease and oil during the laundry process. See soil release agents' definition, p. 278-279, "Liquid Detergents" by Kuo-Yann Lai. For use herein, preferred level of soil release polymer per kilogram of load is from about 0.01 to about 0.8 grams, more preferably the level of polymer is less than 0.2 grams especially from about 0.05 to about 0.15 grams. Contrary to what one would expect higher levels of soil release polymer do not enhance removal. In some cases removal is worse than with lower levels.

The soil release polymer used in the method of the present invention includes a variety of charged, e.g., anionic or cationic (see U.S. Pat. No. 4,956,447), as well as non-charged monomer units and structures may be linear, branched or star-shaped. They may include capping moieties which are especially effective in controlling molecular weight or altering the physical or surface-active properties.

Suitable soil release polymers for use herein include a sulfonated product of a substantially linear ester oligomer comprised of an oligomeric ester backbone of terephthaloyl and oxyalkyleneoxy repeat units, for example as described in U.S. Pat. No. 4,968,451. Suitable soil release polymers for use herein include also polymer such as defined in U.S. Pat. No. 4,711,730, for example those produced by transesterification/oligomerization of poly(ethyleneglycol) methyl ether, dimethyl terephthalate ("DMT"), propylene glycol ("PG") and poly(ethyleneglycol) ("PEG"). Suitable polymers also include polymers defined in partly- and fully-anionic-end-capped oligomeric esters of U.S. Pat. No. 4,721,580, such as oligomers from ethylene glycol ("EG"), PG, DMT and Na-3,6-dioxa-8-hydroxyoctanesulfonate; also the nonionic-capped block polyester oligomeric compounds of U.S. Pat. No. 4,702,857, for example produced from DMT, Me-capped PEG and EG and/or PG, or a combination of DMT, EG and/or PG, Me-capped PEG and Na-dimethyl-5-sulfoisophthalate; and also the anionic, especially sulfoaroyl, end-capped terephthalate esters of U.S. Pat. No. 4,877,896.

Soil release polymers suitable for use herein also encompass simple copolymeric blocks of ethylene terephthalate or propylene terephthalate with polyethylene oxide or polypropylene oxide terephthalate (see U.S. Pat. Nos. 3,959,230 and 3,893,929) cellulosic derivatives such as the hydroxyether cellulosic polymers available as METHOCEL from Dow; and the $C_1$-$C_4$ alkylcelluloses and $C_4$ hydroxyalkyl celluloses.

Soil release polymers for use herein also encompass polymer characterized by poly(vinyl ester) hydrophobic segments including graft copolymers of poly(vinyl ester), e.g., $C_1$-$C_6$ vinyl esters, preferably poly(vinyl acetate), grafted onto polyalkylene oxide backbones (see U.S. Pat. No. 4,000,093 and EP 0219048). Commercially available examples of soil release polymers include SOKALAN®, such as SOKALAN HP-22®, available from BASF.

Other soil release polymers of the present invention can be polyesters with repeat units containing 10-15% by weight of ethylene terephthalate together with 90-80% by weight of polyoxyethylene terephthalate, derived from a polyoxyethylene glycol of average molecular weight 300-5,000. Commercial examples include ZELCON® 5126 from Dupont and MILEASE® from ICI.

Suitable monomers for the above soil release polymers include Na 2-(2-hydroxyethoxy)-ethanesulfonate, DMT, Na-dimethyl 5-sulfoisophthalate, EG and PG (U.S. Pat. No. 5,415,807).

Additional classes of soil release polymer suitable for use herein include:

(I) nonionic terephthalates using diisocyanate coupling agents to link up polymeric ester structures (see U.S. Pat. Nos. 4,201,824 and 4,240,918); (II) soil release polymers with carboxylate terminal groups made by adding trimellitic anhydride to known soil release polymers to convert terminal hydroxyl groups to trimellitate esters. With a proper selection of catalyst, the trimellitic anhydride forms linkages to the terminals of the polymer through an ester of the isolated carboxylic acid of trimellitic anhydride rather than by opening of the anhydride linkage. Either nonionic or anionic soil release polymers of the present invention may be used as starting materials as long as they have hydroxyl terminal groups which may be esterified (See U.S. Pat. No. 4,525,524); (III) anionic terephthalate-based soil release polymers of the urethane-linked variety (see U.S. Pat. No. 4,201,824); (IV) poly(vinyl caprolactam) and related copolymers with monomers such as vinyl pyrrolidone and/or dimethylaminoethyl methacrylate, including both nonionic and cationic polymers (U.S. Pat. No. 4,579,681); (V) graft copolymers, in addition to the SOKALAN® types made from BASF, by grafting acrylic monomers on to sulfonated polyesters; these soil release polymers have soil release and anti-redeposition activity similar to known cellulose ethers (see EP 279,134); (VI) grafts of vinyl monomers such as acrylic acid and vinyl acetate on to proteins such as caseins (see EP 457,205); (VII) polyester-polyamide soil release polymers prepared by condensing adipic acid, caprolactam, and polyethylene glycol, especially for treating polyamide fabrics (see DE 2,335,04). Other useful soil release polymers are described in U.S. Pat. Nos. 4,240,918, 4,787,989, 4,525,524 and 4,877,896.

In a preferred embodiment, the soil release polymer for use herein has the formula:

$$X—[(OCH_2CH_2)_n(OR^5)_m]\text{-}[(A\text{-}R^1\text{-}A\text{-}R^2)_u(A\text{-}R^3\text{-}A\text{-}R^2)_v]\text{-}A\text{-}R^4\text{-}A\text{-}[(R^5O)_m(CH_2CH_2O)]X$$

In this formula, the moiety $[(A\text{-}R^1\text{-}A\text{-}R^2)_u(A\text{-}R^3\text{-}A\text{-}R^2)_v]\text{-}A\text{-}R^4\text{-}A\text{-}$ forms the oligomer or polymer backbone of the compounds. Groups $X—[(OCH_2CH_2)_n(OR^5)_m]$ and $[(R^5O)_m(CH_2CH_2O)_n]—X$ are generally connected at the ends of the oligomer/polymer backbone.

The linking A moieties are essentially

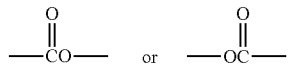

moieties, i.e. the compounds of the present invention are polyesters.

As used herein, the term "the A moieties are essentially

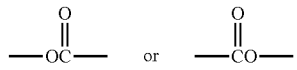

moieties" refers to compounds where the A moieties consist entirely of moieties

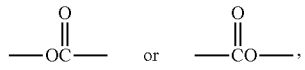

or are partially substituted with linking moieties such as

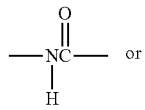

-continued

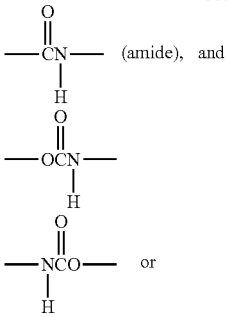

(urethane). The degree of partial substitution with these other linking moieties should be such that the soil release properties are not adversely affected to any great extent. Preferably, linking moieties A consist entirely of (i.e., comprise 100%) moieties

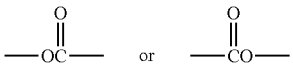

i.e., each A is either

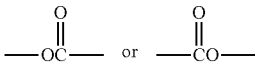

The $R^1$ moieties are essentially 1,4-phenylene moieties.

As used herein, the term "the $R^1$ moieties are essentially 1,4-phenylene moieties" refers to compounds where the $R^1$ moieties consist entirely of 1,4-phenylene moieties, or are partially substituted with other arylene or alkarylene moieties, alkylene moieties, alkenylene moieties, or mixtures thereof. Arylene and alkarylene moieties which can be partially substituted for 1,4-phenylene include 1,3-phenylene, 1,2-phenylene, 1,8-naphthylene, 1,4-naphthylene, 2,2'-biphenylene, 4,4'-biphenylene and mixtures thereof. Alkylene and alkenylene moieties which can be partially substituted include ethylene, 1,2-propylene, 1,4-butylene, 1,5-pentylene, 1,6-hexamethylene, 1,7-heptamethylene, 1,8-octamethylene, 1,4-cyclohexylene, and mixtures thereof.

For the $R^1$ moieties, the degree of partial substitution with moieties other than 1,4-phenylene should be such that the soil release properties of the compound are not adversely affected to any great extent. Generally, the degree of partial substitution which can be tolerated will depend upon the backbone length of the compound, i.e., longer backbones can have greater partial substitution for 1,4-phenylene moieties. Usually, compounds where the $R^1$ comprise from about 50 to 100%, 1,4-phenylene moieties (from 0 to 50% moieties other than 1,4-phenylene) have adequate soil release activity. For example, polyesters made according to the present invention with a 40:60 mole ratio of isophthalic (1,3-phenylene) to terephthalic (1,4-phenylene) acid have adequate soil release activity. However, because most polyesters used in fibber making comprise ethylene terephthalate units, it is usually desirable to minimize the degree of partial substitution with moieties other than 1,4-phenylene for best soil release activity. Preferably, the $R^1$ moieties consist entirely of (i.e., comprise 100%) 1,4-phenylene moieties, i.e. each $R^1$ moiety is 1,4-phenylene.

The $R^2$ moieties are essentially ethylene moieties, or substituted ethylene moieties having $C_1$-$C_4$ alkyl or alkoxy substituents. As used herein, the term "the $R^2$ moieties are essentially ethylene moieties, or substituted ethylene moieties having $C_1$-$C_4$ alkyl or alkoxy substituents" refers to compounds of the present invention where the $R^2$ moieties consist entirely of ethylene, or substituted ethylene moieties, or are partially substituted with other compatible moieties. Examples of these other moieties include linear $C_3$-$C_6$ alkylene moieties such as 1,3-propylene, 1,4-butylene, 1,5-pentylene or 1,6-hexamethylene, 1,2-cycloalkylene moieties such as 1,2-cyclohexylene, 1,4-cycloalkylene moieties such as 1,4-cyclohexylene and 1,4-dimethylenecyclohexylene, polyoxy-alkylated 1,2-hydroxyalkylenes such as

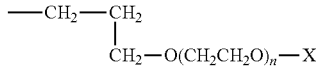

and oxy-alkylene moieties such as $$—CH_2CH_2OCH_2CH_2OCH_2CH_2— \text{ or}$$

$$—CH_2CH_2OCH_2CH_2—$$

For the $R^2$ moieties, the degree of partial substitution with these other moieties should be such that the soil release properties of the compounds are not adversely affected to any great extent.

Generally, the degree of partial substitution which can be tolerated will depend upon the backbone length of the compound, i.e. longer backbones can have greater partial substitution. Usually, compounds where the $R^2$ comprise from 20 to 100% ethylene, or substituted ethylene moieties (from 0 to 80% other compatible moieties) have adequate soil release activity. For example, for polyesters made according to the present invention with a 75:25 mole ratio of diethylene glycol ($—CH_2CH_2OCH_2CH_2—$) to ethylene glycol (ethylene) have adequate allergen repellency activity. However, it is desirable to minimize such partial substitution, especially with oxyalkylene moieties, for best soil release activity.

Preferably, $R^2$ comprises from 80 to 100% ethylene, or substituted ethylene moieties, and from 0 to 20% other compatible moieties. For the $R^2$ moieties, suitable ethylene or substituted ethylene moieties include ethylene, 1,2-propylene, 1,2-butylene, 1,2-hexylene, 3-methoxy-1,2-propylene and mixtures thereof. Preferably, the $R^2$ moieties are essentially ethylene moieties, 1,2-propylene moieties or mixtures thereof. Inclusion of a greater percentage of ethylene moieties tends to improve the soil release activity of the compounds. Surprisingly, inclusion of a greater percentage of 1,2-propylene moieties tends to improve the water solubility of the compounds.

For the $R^3$ moieties, suitable substituted $C_2$-$C_{18}$ hydrocarbylene moieties can include substituted $C_2$-$C_{12}$ alkylene, alkenylene, arylene, alkarylene and like moieties. The substituted alkylene or alkenylene moieties can be linear, branched, or cyclic. Also, the $R^3$ moieties can be all the same (e.g. all substituted arylene) or a mixture (e.g. a mixture of substituted arylenes and substituted alkylenes). Preferred $R^3$ moieties are those which are substituted 1,3-phenylene moieties. The substituted $R^3$ moieties preferably have only one $—SO_3M$, —COOM, $—O[(R^5O)_m(CH_2CH_2O)_n]X$ or $-A[(R^2\text{-}A\text{-}R^4\text{-}A)]_w[(R^5O)_m(CH_2CH_2O)_n—]X$ substituent.

M can be H or any compatible water-soluble cation. Suitable water soluble cations include the water soluble alkali metals such as potassium (10 and especially sodium ($Na^+$), as well as ammonium ($NH_4^+$). Also suitable are substituted ammonium cations having the formula:

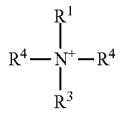

where $R^1$ and $R^2$ are each a $C_1$-$C_{20}$ hydrocarbyl group (e.g. alkyl, hydroxyalkyl) or together form a cyclic or heterocyclic ring of from 4 to 6 carbon atoms (e.g. piperidine, morpholine); $R^3$ is a $C_1$-$C_{20}$ hydrocarbyl group; and $R^4$ is H (ammonium) or a $C_1$-$C_{20}$ hydrocarbyl group (quat amine). Typical substituted ammonium cationic groups are those where $R^4$ is H (ammonium) or $C_1$-$C_4$ alkyl, especially methyl(quat amaine); $R^1$ is $C_{10}$-$C_{18}$ alkyl, especially $C_{12}$-$C_{14}$ alkyl; and $R^2$ and $R^3$ are each $C_1$-$C_4$ alkyl, especially methyl.

to 25, i.e. the compounds of the present invention are oligomers or low molecular weight polymers. By comparison, polyesters used in fibber making typically have a much higher molecular weight, e.g. have from 50 to 250 ethylene terephthalate units. Typically, the sum of u+v ranges from 3 to 10 for the compounds of the present invention.

Generally, the larger the u+v value, the less soluble is the compound, especially when the $R^3$ moieties do not have the substituents —COOM or —$SO_3M$. Also, as the value for n increases, the value for u+v should be increased so that the compound will deposit better on the fabric during laundering. When the $R^3$ moieties have the substituent -A[($R^2$-A-$R^4$—)]$_w$$R^5O)_m(CH_2CH_2O)_nX$ (branched compounds) or -A[($R^2$-A-$R^4$-A)]$_w$$R^2$-A-(cross-linked compounds), the value for w is typically at least 1 and is determined by the process by which the compound is made. For these branched and cross-linked compounds the value for u+v+w is from 3 to 25.

Preferred compounds of the present invention are block polyesters having the formula

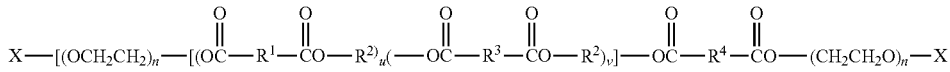

The $R^3$ moieties having -A[($R^2$-A-$R^4$-A)]$_w$[($R^5O)_m$ $(CH_2CH_2O)_n$—]—X substituents provide branched compounds. $R^3$ moieties having -A[($R^2$-A-$R^4$-A)]$_w$-$R^2$-A moieties provide cross-linked compounds. Indeed, syntheses used to make the branched compounds typically provide at least some cross-linked compounds.

The moieties —($R^5O$)— and —($CH_2CH_2O$)— of the moieties [($R^5O)_m(CH_2CH_2O)_n$] and [$(OCH_2CH_2)_n(OR^5)_m$] can be mixed together or preferably form blocks of —($R^5O$)— and —($CH_2CH_2O$)— moieties.

Preferably, the blocks of —($R^5O$)— moieties are located next to the backbone of the compound. When $R^5$ is the moiety —$R^2$-A-$R^6$, m is 1; also, the moiety —$R^2$-A-$R^6$— is preferably located next to the backbone of the compound.

For $R^5$, the preferred $C_3$-$C_4$ alkylene is $C_3H_6$ (propylene); when $R_5$ is $C_3$-$C_4$ alkylene, m is preferably from 0 to 5 and is most preferably 0. $R^6$ is preferably methylene or 1,4-phenylene. The moiety —($CH_2CH_2O$)— preferably comprises at least 75% by weight of the moiety [($R^5O)_m$ $(CH_2CH_2O)_n$] and most preferably 100% by weight (m is 0). X can be H, $C_1$-$C_4$ alkyl or

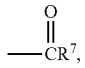

wherein $R^7$ is $C_1$-$C_4$ alkyl. X is preferably methyl or ethyl, and most preferably methyl. The value for each n is at least 6, but is preferably at least 10. The value for each n usually ranges from 12 to 113. Typically, the value for each n is in the range of from 12 to 43.

The backbone moieties (A-$R^1$-A-$R^2$) and (A-$R^3$-A-$R^2$) can be mixed together or can form blocks of (A-$R^1$-A-$R^2$) and (A-$R^3$-A-$R^2$) moieties. It has been found that the value of u+v needs to be at least 3 in order for the compounds of the present invention to have significant soil release activity. The maximum value for u+v is generally determined by the process by which the compound is made, but can range up wherein the $R^1$ moieties are all 1,4-phenylene moieties; the $R^2$ moieties are essentially ethylene moieties, 1,2-propylene moieties or mixtures thereof; the $R^3$ moieties are all potassium or preferably sodium 5-sulfo-1,3-phenylene moieties or substituted 1,3-phenylene moieties having the substituent

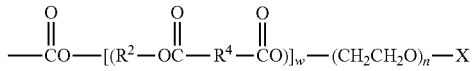

at the 5 position; the $R^4$ moieties are $R^1$ or $R^3$ moieties, or mixtures thereof; each X is ethyl or preferably methyl; each n is from 12 to 43; when w is 0, u+v is from 3 to 10; when w is at least 1, u+v+w is from 3 to 10.

Particularly preferred block polyesters are those where v is 0, i.e. the linear block polyesters. For these most preferred linear block polyesters, u typically ranges from 3 to 8, especially for those made from dimethyl terephthalate, ethylene glycol (or 1,2-propylene glycol) and methyl capped polyethylene glycol. The most water soluble of these linear block polyesters are those where u is from 3 to 5.

In a preferred embodiment, the soil release polymers of the present invention have the formula (I):

$$X—[(OCH_2CH_2)_n(OR^5)_m]-[(A-R^1-A-R^2)_u(A-R^3-A-R^2)_v]-A-R^4-A-[R^5O)_m(CH_2CH_2O)_n]X$$

wherein each of the moieties A is selected form the group consisting of

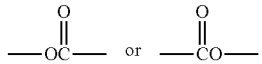

or and combination thereof with either or both of the moieties,

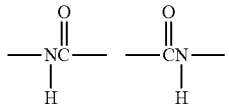

wherein: each of the $R^1$ moieties is selected from the group consisting of 1,4-phenylene and combination thereof with 1,3-phenylene, 1,2-phenylene, 1,8-naphthylene, 1,4-naphthylene, 2,2'-biphenylene, 4,4'-biphenylene and mixtures thereof. Alkylene and alkenylene moieties can be partially substituted including ethylene, 1,2-propylene, 1,4-butylene, 1,5-pentylene, 1,6-hexamethylene, 1,7-heptamethylene, 1,8-octamethylene, 1,4-cyclohexylene or mixtures thereof. In a more preferred embodiment, the $R^1$ moieties are 1,4-phenylene moieties, or are partially substituted with arylene, alkarylene, alkylene or alkenylene moieties, or mixtures thereof.

Preferably, in the formula (I), v is 0. More preferably, in the formula (I), $R^1$ moieties comprise from 50 to 100% of said 1,4-phenylene moieties. Even More preferably each $R^1$ moieties is a 1,4-phenylene moiety.

In a more preferred embodiment, in the formula (I), the $R^3$ moieties are selected from the group consisting of substituted $C_2$-$C_{12}$ alkylene, alkenylene, arylene, alkarylene and mixture thereof. More preferably, $R^3$ moieties has only one substituent $-A[(R^2-A-R^4-A)]_w(R^5O)_m(CH_2CH_2O)_n]X$ and w is 1.

In another preferred embodiment, in the formula (I), $R^2$ moieties comprise from 20 to 100%, preferably from 80 to 100% of ethylene moieties or substituted ethylene moieties Most preferably, in the formula (I), in the polymer according to the present invention m is 0 and n is from 12 to 119, more preferably form 12 to 43.

In preferred embodiments, the soil release polymer for use in the present invention has the formula (II):

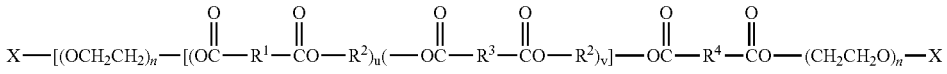

the $R^2$ moieties are selected from the group consisting of ethylene moieties, substituted ethylene moieties having $C_1$-$C_4$ alkyl or alkoxy substituents or mixtures thereof;

the $R^3$ moieties are substituted $C_2$-$C_{18}$ hydrocarbylene moieties having at least one —COOM, $—O[(R^5O)_m(CH_2CH_2O)_n]X$ or $-A[(R^2-A-R^4-A)_w(R^5O)_m(CH_2CH_2O)_n]X$ substituent;

the $R^4$ moieties are $R^1$ or $R^3$ or mixtures thereof.

each $R^5$ is $C_3$-$C_4$ alkylene, or the moiety $—R^2-A-R^6—$, wherein $R^6$ is a $C_1$-$C_{12}$ alkylene, alkenylene, arylene or alkarylene moiety;

M is H or a water-soluble cation; each X is $C_1$-$C_4$ alkyl; m and n are number such that the moiety $—(CH_2CH_2O)—$ comprise at least 50% by weight of the moiety $[(R^5O)_m(CH_2CH_2O)_n]$, provided that when $R^5$ is the moiety $—R^2-A-R^6—$, m is 1; n is at least 10; u and v are numbers such that the sum of u+v is from 3 to 25; w is 0 or at least 1; and when w is at least 1, u, v and w are numbers such that the sum of u+v+w is from 3 to 25.

wherein: each $R^1$ moieties is a 1,4-phenylene moiety;

the $R^2$ moieties are each selected from the group consisting of ethylene moieties, 1,2-propylene moieties, 1,2 butylene moieties, 1,2 hexylene moieties, 3-methoxy-1,2 propylene moieties or mixture thereof, provided that said $R^2$ are not exclusively 1,2 butylene moieties, 1,2 hexylene moieties, 3-methoxy-1,2 propylene moieties or mixture thereof;

the $R^3$ moieties are each selected from the group consisting of substituted 1,3-phenylene moieties having the substituent

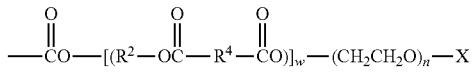

at the 5 position;

the $R^4$ moieties are $R^1$ or $R^3$ moieties, or mixtures thereof;

each X is $C_1$-$C_4$ alkyl; each n is from 12 to 43;

when w is 0, u+v is from 3 to 10;

when w is at least 1, u+v+w is from 3 to 10.

Preferably, in the formula (II), v is 0. More preferably, in the formula (II), $R^2$ moieties comprise from 80 to 100% ethylene moieties, 1,2-propylene moieties, or mixture thereof.

In an embodiment of the present invention, the soil release polymer has the formula:

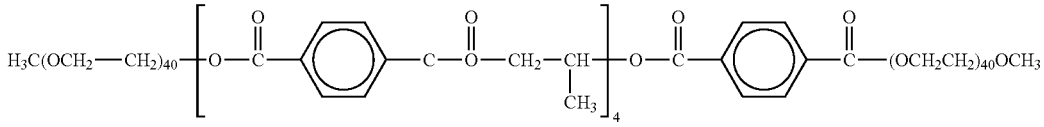

In a more preferred embodiment, in the formula (I), each moieties A is

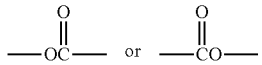

The soil release polymers of the present invention can be prepared by art-recognized methods. U.S. Pat. Nos. 4,702,857 and 4,711,730 describe the preferred method of synthesis for the block polyesters of the present invention.

The soil release polymer is present in the composition in an amount of from about 0.1 wt. % to about 25 wt. %, preferably from about 0.5 wt. % to about 20 wt. % and more preferably from about 1 wt. % to about 15 wt. %. Applicants have surprisingly found that these polymers when present in the correct levels can form stable solid compositions in an acid environment that allows for cleaning in the alkaline removal step.

Hardening Agent

A hardening agent, as used in the present method and compositions, is a compound or system of compounds, organic or inorganic, that significantly contributes to the uniform solidification of the composition. Preferably, the hardening agents are compatible with the cleaning agent and other active ingredients of the composition, and are capable of providing an effective amount of hardness and/or aqueous solubility to the processed composition. The hardening agents should also be capable of forming a homogeneous matrix with the cleaning agent and other ingredients when mixed and solidified to provide a uniform dissolution of the cleaning agent from the solid composition during use.

The amount of hardening agent included in the cleaning composition will vary according to the type of composition being prepared, the ingredients of the composition, the intended use of the composition, the quantity of dispensing solution applied to the solid composition over time during use, the temperature of the dispensing solution, the hardness of the dispensing solution, the physical size of the solid composition, the concentration of the other ingredients, the concentration of the cleaning agent in the composition, and other like factors. It is preferred that the amount of the hardening agent is effective to combine with the cleaning agent and other ingredients of the composition to form a homogeneous mixture under continuous mixing conditions and a temperature at or below the melting temperature of the hardening agent.

It is also preferred that the hardening agent form a matrix with the cleaning agent and other ingredients which will harden to a solid form under ambient temperatures of about 30 to 50° C., preferably about 35 to 45° C., after mixing ceases and the mixture is dispensed from the mixing system, within about 1 minute to about 3 hours, preferably about 2 minutes to about 2 hours, preferably about 5 minutes to about 1 hour. A minimal amount of heat from an external source may be applied to the mixture to facilitate processing of the mixture. It is preferred that the amount of the hardening agent included in the composition is effective to provide a hardness and desired rate of controlled solubility of the processed composition when placed in an aqueous medium to achieve a desired rate of dispensing the cleaning agent from the solidified composition during use.

The preferred organic hardening agent is a polyethylene glycol (PEG) compound for use in the above cleaning composition. The solidification rate of cleaning compositions comprising a polyethylene glycol hardening agent made according to the invention will vary, at least in part, according to the amount and the molecular weight of the polyethylene glycol added to the composition.

Polyethylene glycol compounds useful according to the invention include, for example, solid polyethylene glycols of the general formula $H(OCH_2—CH_2)_nOH$, where n is greater than 15, more preferably about 30 to 1700. Solid polyethylene glycols which are useful are commercially available from Union Carbide under the name CARBOWAX. Typically, the polyethylene glycol is a solid in the form of a free-flowing powder or flakes, having a molecular weight of about 1000 to 100,000, preferably having a molecular weight of at least about 1450 to 20,000, more preferably between about 1450 to about 8000. The polyethylene glycol is present at a concentration of from about 1 to 75 wt.-%, preferably about 3 to 15 wt.-%. Suitable polyethylene glycol compounds useful according to the invention include, for example, PEG 1450 and PEG 8000 among others, with PEG 8000 being most preferred.

Preferred inorganic hardening agents are hydratable inorganic salts, such as sulfates, acetates, carbonates, and bicarbonates. The inorganic hardening agents are present at concentrations of about 0 to 50 wt.-%, preferably about 0.5-25 wt.-%, more preferably about 1-15 wt.-%.

Quaternary Ammonium Fabric Softener

Optionally the solid sour composition can include a quaternary ammonium compound for fabric softening capabilities. They have the following general formula:

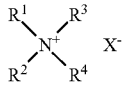

wherein $R^1$ and $R^2$ represent the same or different hydrocarbyl groups having from about 12 to about 24 carbon atoms; $R^3$ and $R^4$ represent the same or different hydrocarbyl groups containing about 1 to about 4 carbon atoms; and X is an anion, preferably selected from halide, methyl sulphate or ethyl sulphate radicals.

Representative examples of these quaternary softeners include, for example, di(tallow alkyl)dimethyl ammonium methyl sulphate; dihexadecyl dimethyl ammonium chloride; di(hydrogenated tallow alkyl)dimethyl ammonium chloride; dioctadecyl dimethyl ammonium chloride; di(hydrogenated tallow alkyl)dimethyl ammonium methyl sulphate; dihexadecyl diethyl ammonium chloride; di(coconut alkyl)dimethyl ammonium chloride; ditallow alkyl dimethyl ammonium chloride; and di(hydrogenated tallow alkyl)dimethyl ammonium chloride, and combinations thereof.

Other preferred quaternary softeners can contain ester or amide links, such as those available under the trade names ACCOSOFT® (available from Stepan Company, Northfield, Ill.), VARISOFT® (available from Degussa Corporation, Parsippany, N.J.), and STEPANTEX® (available from Stepan Company).

It is especially preferred that the additional fabric softening active of the present technology be a quaternary ammonium material which comprises a compound having at least two or more $C_{12-18}$ alkyl or alkenyl groups connected to the molecule via at least one ester link. It is more preferred that the quaternary ammonium compound have two or more ester links present. The especially preferred ester-linked quaternary ammonium compounds (i.e., ester quats) for use in the presently described technology can be represented by the formula:

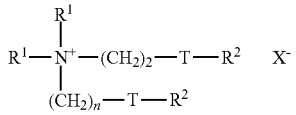

wherein each $R^1$ group is independently selected from $C_{1-4}$ alkyl, hydroxyalkyl (e.g. hydroxyethyl) or $C_{2-4}$ alkenyl groups; and wherein each $R_2$ group is independently selected from $C_{8-28}$ alkyl or alkenyl groups; T is

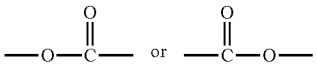

$X^-$ is any suitable anion and n is 0 or an integer from 1-5.

Preferred compounds of this class of cationic fabric softening compounds suitable for use in various compositions of the present technology include, for example, dialkenyl esters of triethanol ammonium methyl sulphate and N,N-di(tallowoyloxy ethyl)N,N-dimethyl ammonium chloride. Commercial examples of compounds include, but are not limited to, TETRANYL® AOT-1 (di-oleic ester of triethanol ammonium methyl sulphate 80% active by weight), TETRANYL®. A0-1 (di-oleic ester of triethanol ammonium methyl sulphate 90% active by weight), TETRANY®. L1/90 (partially hardened tallow ester of triethanol ammonium ethyl sulphate 90% active by weight), TETRANYL®. L5/90 (palm ester of triethanol ammonium methyl sulphate 90% active by weight), and TETRANYL® AHT-1 (hardened tallow ester of triethanol ammonium methyl sulphate 90% active by weight), all available from Kao Corporation, Japan, and REWOQUAT®. 'WE15 ($C_{10}$-$C_{20}$ and $C_{16}$-$C_{20}$ unsaturated carboxylic acid reaction products with triethanolamine dimethyl sulphate quaternized 90% active by weight), available from Witco Corporation, Greenwich, Conn.

A second preferred type of quaternary ammonium material of the present technology can be represented by formula:

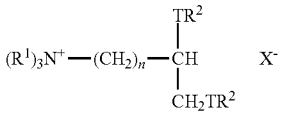

wherein $R^1$, $R^2$, T, $X^-$ and n are as defined above. Preferred compounds of this type include, for example, 1,2 bis[hardened tallowoyloxy]-3-trimethylammonium propane chloride, and their methods of preparation are, for example, described in U.S. Pat. No. 4,137,180 (Lever Brothers Company, New York, N.Y.). Preferably these materials comprise small amounts of the corresponding monoester as described in U.S. Pat. No. 4,137,180 such as a 1-hardened tallowoyloxy-2-hydroxy trimethylammonium propane chloride.

It is advantageous for environmental reasons that the quaternary ammonium material for the present technology be biologically degradable, for example, such as those materials described in U.S. Pat. No. 6,958,313 (The Procter & Gamble Company, Cincinnati, Ohio).

The fabric softening active may also be a polyol ester quat (PEQ) as described in EP 0638 639 (Akzo Nobel, Netherlands). Other additional fabric softening actives may also be applicable in the present technology. For example those described in "Cationic surface active agents as fabric softeners," R. R. Egan, Journal of American Oil Chemist Society, January 1978, Pages 118-121; "How to chose cationic for fabric softeners," J. A. Ackerman, Journal of American Oil Chemist Society, June 1983, pages 1166-1169; and "Rinse-Added Fabric Softener Technology at the Close of the Twentieth Century," M. I. Levinson, Journal of Surfactants and Detergents, April 1999, Vol. 2, Pages 223-235, incorporated herein as references.

Examples of quaternary ammonium compounds suitable for use in the presently described technology include, but are not limited to, triethanolamine (TEA) ester quats (e.g., methyl bis(ethyl tallowate)-2-hydroxyethyl ammonium methyl sulfate), methyldiethanolamine (MDEA) ester quats, diamidoquats (e.g., methyl bis(hydrogenated tallow amidoethyl)-2-hydroxyethyl ammonium methyl sulfate), and dialkyldimethyl quats (e.g., dihydrogenated tallow dimethyl ammonium chloride). Preferred ester quats are those made from the reaction of alkyl carboxylic acid fraction, methyl ester and triglyceride with triethanolamine where the carboxylic acid and methyl ester:tertiary amine mole ratio is in the range of from about 1:1 to about 2.5:1. Specific commercially available examples of the suitable additional fabric softening active include, but are not limited to, the STEPANTEX® series products (e.g., VT-90, SP-90, and VK-90) and the ACCOSOFT® series products (e.g., 400, 440-75 and 275), all available from Stepan Company.

The ammonium quaternary fabric softening active, if presents is present at a level in the range of from about 0 wt. % to about 20%, preferably from about 0.1% to about 10%, and most preferably from about 0.5% to about 5% by weight based on the total weight of the fabric softener composition.

Other Additives

The solid sour composition can include any other additives that are traditionally found in laundry cleaning products, such as sequestering agents, bleaching agents, detergent builders or fillers, hardening agents or solubility modifiers, defoamers, anti-redeposition agents, threshold agents, stabilizers, chelants, builders, dispersants, enzymes, aesthetic enhancing agents (i.e., dye, perfume), and the like. Adjuvants and other additive ingredients will vary according to the type of composition being manufactured. It should be understood that these additives are optional and need not be included in the treatment composition. When they are included, they can be included in an amount that provides for the effectiveness of the particular type of component.

Chelant

The treatment composition may optionally also include a chelant. Suitable chelants include amino polycarboxylates, including but not limited to diethylene triamine pentaacetate, diethylene triamine penta(methyl phosphonic acid), ethylene diamine-N'N'-disuccinic acid, ethylene diamine tetraacetate, ethylene diamine tetra(methylene phosphonic acid) and hydroxyethane di(methylene phosphonic acid). Preferably the chelating agent is a biodegradable aminopolycarboxylate such as glutamic acid (GLDA), methylglycinediacetic acid (MGDA), L-aspartic acid N,N-diacetic acid tetrasodium salt (ASDA), DEG/HEIDA (sodium diethanolglycine/2-hydroxyethyliminodiacetic acid, disodium salt), iminodisuccinic acid and salts (IDS), and ethylenediaminedisuccinic acid and salts (EDDS). When present the chelant may be in the composition in an amount of from about 0% to about 8% preferably from about 0% to 6% and more preferably from about 0% to 4% by weight of the composition.

Water Conditioning Agents

Water conditioning polymers can be present as a form of builder. Exemplary water conditioning polymers include polycarboxylates. Exemplary polycarboxylates that can be used as builders and/or water conditioning polymers include those having pendant carboxylate ($—CO_2.^-$) groups and include, for example, polyacrylic acid, maleic/olefin copolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, hydrolyzed acrylonitrile-methacrylonitrile copolymers, and the like. For a further discussion of chelating agents/sequestrants, see Kirk-Othmer, Encyclopedia of Chemical Technology, Third Edition, volume 5, pages 339-366 and volume 23, pages 319-320, the disclosure of which is incorporated by reference herein.

Bleaching Agents

Bleaching agents for use in an acidic cleaning/sour composition for whitening a substrate or stain removal include bleaching compounds capable of liberating active oxygen. such as hydrogen peroxide, peroxycarboxylic acids, or a combination thereof. The composition can include an effective amount of a bleaching agent. In a preferred embodiment when the treatment composition includes a bleaching agent, it can be included in an amount of about 0.1 wt. % to about 60 wt. %, more preferably between about 1 wt. % and about 20 wt. %, and most preferably between about 5 wt. % and about 15 wt. %.

Fillers

The composition can include an effective amount of fillers, which do not perform as a cleaning/sour agent per se, but cooperates with the cleaning agent to enhance the overall cleaning capacity of the composition. Examples of fillers suitable for use in the present cleaning compositions include sodium sulfate, sodium chloride, starch, sugars, alcohols $C_1$-$C_{10}$ alkylene glycols such as propylene glycol, and the like. When the composition includes a detergent filler, it can be included an amount of about 1 wt. % to about 80 wt. %.

Defoaming Agent

A defoaming agent for reducing the stability of foam may also be included in the composition to reduce foaming. When the composition includes a defoaming agent, the defoaming agent can be provided in an amount of between about 0.01 wt. % and about 3 wt. %.

Examples of defoaming agents that can be used in the composition includes ethylene oxide/propylene block copolymers, silicone compounds such as silica dispersed in polydimethylsiloxane, polydimethylsiloxane, and functionalized polydimethylsiloxanes such as those available under the name Abil B9952, fatty amides, hydrocarbon waxes, fatty acids, fatty esters, fatty alcohols, fatty acid soaps, ethoxylates, mineral oils, polyethylene glycol esters, alkyl phosphate esters such as monostearyl phosphate, and the like. A discussion of defoaming agents may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated by reference herein.

Anti-Redeposition Agent

The treatment composition can include an anti-redeposition agent for facilitating sustained suspension of soils in a cleaning solution and preventing the removed soils from being redeposited onto the substrate being cleaned. Examples of suitable anti-redeposition agents include fatty acid amides, fluorocarbon surfactants, complex phosphate esters, styrene maleic anhydride copolymers, and cellulosic derivatives such as hydroxyethyl cellulose, hydroxypropyl cellulose, and the like. In a preferred embodiment, the anti-redeposition agent when present in the treatment composition, is added in an amount between about 0.5 wt. % and about 10 wt. %, and more preferably between about 1 wt. % and about 5 wt. %.

Stabilizing Agent

Stabilizing agents that can be used include citric acid, glycerine, maleonic acid, organic diacids, polyols, propylene glycol, and mixtures thereof. The treatment composition need not include a stabilizing agent, but when the concentrate includes a stabilizing agent, it can be included in an amount that provides the desired level of stability of the concentrate. In a preferred embodiment the amount of stabilizing agent is about 0 to about 20 wt. %, more preferably about 0.5 wt. % to about 15 wt. %, and most preferably about 2 wt. % to about 10 wt. %.

Dispersants

Dispersants that can be used in the composition include maleic acid/olefin copolymers, polyacrylic acid, and mixtures thereof. The concentrate need not include a dispersant, but when a dispersant is included it can be included in an amount that provides the desired dispersant properties. Exemplary ranges of the dispersant in the treatment composition can be between about 0 and about 20 wt. %, more preferably between about 0.5 wt. % and about 15 wt. %, and most preferably between about 2 wt. % and about 9 wt. %.

Water

The solid sour composition can include water. In general, it is expected that water may be present as a processing aid and may be removed or become water of hydration. It is expected that water may be present in both liquid concentrate and in solid concentrate forms of the treatment composition. In the case of the liquid concentrate, it is expected that water will be present in a range of between about 5 wt. % and about 95 wt. %, more preferably between about 20 wt. % and about 75 wt. %, and most preferably between about 30 wt. % and about 50 wt. %. In the case of a solid concentrate, it is expected that the water will be present in ranges between about 5 wt. % and about 60 wt. %, more preferably between about 15 wt. % and about 45 wt. %, and most preferably between about 25 wt. % and about 40 wt. %. It should be additionally appreciated that the water may be provided as deionized water or as softened water.

Other

Various dyes, odorants including perfumes, and other aesthetic enhancing agents can be included in the composition. Dyes may be included to alter the appearance of the composition, as for example, Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keystone Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (Ciba-Geigy), and the like.

Fragrances or perfumes that may be included in the compositions include, for example, terpenoids such as citronellol, aldehydes such as amyl cinnamaldehyde, a jasmine such as C1S-jasmine or jasmal, vanillin, and the like.

The solid sour compositions of the invention may exist in a use solution or concentrated solution that is in any form including liquid, free flowing granular form, powder, gel, paste, solids, slurry, and foam. The treatment composition of this invention may be used at any temperature, including an elevated temperature of about 90-180° F.

In the context of one embodiment of a textile washing operation, it is expected that the textile will undergo a textile washing step in the presence of a detergent use solution. At least a portion of the detergent use solution can be drained from the textile prior to the step of treating the textile with a solid sour composition. Alternatively, at least a portion of the detergent use solution can be drained from the textile and the textile can be rinsed to further remove the detergent use solution from the textile prior to the step of treating the textile with a solid sour composition. Various techniques for washing textile with a detergent use solution can be utilized according to the invention for cleaning textile prior to the step of treating with a solid sour composition.

The detergent use solution can be an alkaline or an acidic detergent use solution, but preferably an alkaline detergent is considered. Various techniques for cleaning that include alkaline cleaning are described in United States Patent Application Publication No. 2003/0162682 that was filed with the United States Patent and Trademark Office on Aug. 28, 2003, and U.S. Pat. No. 6,194,371 that was filed on Feb. 7, 2001, the entire disclosures of which is incorporated herein by reference. In general, it is expected that an alkaline wash refers to a wash that takes place at a pH at between about 7 and about 13, and can include a pH of between about 8 and about 12. In general, it is understood that an acid wash refers to a wash having a pH of between about 1 and about 6, and can refer to a wash having a pH in the range of about 2 to about 4.

Conventional Detergent Compositions

The processes of the invention utilize a conventional alkaline detergent composition either after the initial pre-treatment step, or prior to a sour treatment in a final rinse. In some embodiments, the treatment composition may be used as a part of, or packaged with a conventional detergent compositions include surfactants, builders or sequestrants and minor ingredients. The following is a general overview of detergent compositions which may be used in the processes of the invention.

Surfactants

Useful anionic surfactants include the water soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols ($C_{12}$-$C_{18}$ carbon atoms) such as those produced by reducing the glycerides of tallow or coconut oil; and the sodium and potassium alkylbenzene sulfonates in which the alkyl group contains from about 10 to about 16 carbon atoms, in straight chain or branched chain configuration, e.g., see U.S. Pat. Nos. 2,220,099 and 2,477,383. Especially valuable are linear straight chain alkylbenzene sulfonates in which the average number of carbon atoms in the alkyl group is from about 11 to 14, abbreviated as $C_{11-14}$ LAS. Also, preferred are mixtures of $C_{10-16}$ (preferably $C_{11-13}$) linear alkylbenzene sulfonates and $C_{12-18}$ (preferably $C_{14-16}$) alkyl sulfates, alkyl ether sulfates, alcohol ethoxylate sulfates, etc.

Other anionic surfactants herein are the sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl ethylene oxide ether sulfates containing from about 1 to about 10 units of ethylene oxide per molecule and wherein the alkyl groups contain from about 8 to about 12 carbon atoms; and sodium or potassium salts of alkyl ethylene oxide ether sulfates containing about 1 to about 10 units of ethylene oxide per molecule and wherein the alkyl group contains from about 10 to about 20 carbon atoms.

Other useful anionic surfactants herein include the water soluble salts of esters of alpha-sulfonated fatty acids containing from about 6 to 20 carbon atoms in the fatty acid group and from about 1 to 10 carbon atoms in the ester group; water soluble salts of 2-acyloxyalkane-1-sulfonic acids containing from about 2 to 9 carbon atoms in the acyl group and from about 9 to about 23 carbon atoms in the alkane moiety; water soluble salts of olefin and paraffin sulfonates containing from about 12 to 20 carbon atoms; and beta-alkyloxy alkane sulfonates containing from about 1 to 3 carbon atoms in the alkyl group and from about 8 to 20 carbon atoms in the alkane moiety.

Also useful are surface active substances which are categorized as anionics because the charge on the hydrophobe is negative; or surfactants in which the hydrophobic section of the molecule carries no charge unless the pH is elevated to neutrality or above (e.g. carboxylic acids). Carboxylate, sulfonate, sulfate and phosphate are the polar (hydrophilic) solubilizing groups found in anionic surfactants. Of the cations (counterions) associated with these polar groups, sodium, lithium and potassium impart water solubility and are most preferred in compositions of the present invention.

Examples of suitable synthetic, water soluble anionic compounds are the alkali metal (such as sodium, lithium and potassium) salts or the alkyl mononuclear aromatic sulfonates such as the alkyl benzene sulfonates containing from about 5 to about 18 carbon atoms in the alkyl group in a straight or branched chain, e.g., the salts of alkyl benzene sulfonates or of alkyl naphthalene sulfonate, dialkyl naphthalene sulfonate and alkoxylated derivatives. Other anionic detergents are the olefin sulfonates, including long chain alkene sulfonates, long chain hydroxyalkane sulfonates or mixtures of alkenesulfonates and hydroxyalkane-sulfonates and alkylpoly (ethyleneoxy) ether sulfonates. Also included are the alkyl sulfates, alkyl poly (ethyleneoxy) ether sulfates and aromatic poly (ethyleneoxy) sulfates such as the sulfates or condensation products of ethylene oxide and nonyl phenol (usually having 1 to 6 oxyethylene groups per molecule).

Water soluble nonionic surfactants are also useful in the instant detergent granules. Such nonionic materials include compounds produced by the condensation of alkylene oxide groups (hydrophilic in nature) with an organic hydrophobic group or compound, which may be aliphatic or alkyl in nature. The length of the polyoxyalkylene group which is condensed with any particular hydrophobic group can be readily adjusted to yield a water soluble compound having the desired degree of balance between hydrophilic and hydrophobic elements.

Included are the water soluble and water dispersible condensation products of aliphatic alcohols containing from 8 to 22 carbon atoms, in either straight chain or branched configuration, with from 3 to 12 moles of ethylene oxide per mole of alcohol. Nonionic surfactants are generally characterized by the presence of an organic hydrophobic group and an organic hydrophilic group and are typically produced by the condensation of an organic aliphatic, alkyl aromatic or polyoxyalkylene hydrophobic compound with a hydrophilic alkylene oxide moiety which in common practice is ethylene oxide or a polyhydration product thereof, polyethylene glycol. Practically any hydrophobic compound having a hydroxyl, carboxyl, amino, or amido group with a reactive hydrogen atom can be condensed with ethylene oxide, or its polydration adducts, or its mixtures with alkoxylenes such as propylene oxide to form a nonionic surface-active agent. The length of the hydrophilic polyoxyalkylene moiety which is condensed with any particular hydrophobic compound can be readily adjusted to yield a water dispersible or water soluble compound having the desired degree of balance between hydrophilic and hydrophobic properties.

Useful nonionic surfactants include block polyoxypropylene-polyoxyethylene polymeric compounds based upon propylene glycol, ethylene glycol, glycerol, trimethylolpropane, and ethylenediamine as the initiator reactive hydrogen compound. Examples of polymeric compounds made from a sequential propoxylation and ethoxylation of initiator are commercially available under the trade name PLURONIC® manufactured by BASF Corp. PLURONIC® compounds are difunctional (two reactive hydrogens) compounds formed by condensing ethylene oxide with a hydrophobic base formed by the addition of propylene oxide to two hydroxyl groups of propylene glycol. This hydrophobic portion of the molecule weighs from about 1,000 to about 4,000. Ethylene oxide is then added to sandwich this hydrophobe between hydrophilic groups, controlled by length to constitute from about 10% by weight to about 80% by weight of the final molecule. TETRONIC® compounds are tetra-functional block copolymers derived from the sequential additional of propylene oxide and ethylene oxide to ethylenediamine. The molecular weight of the propylene oxide hydrotype ranges from about 500 to about 7,000; and, the hydrophile, ethylene oxide, is added to constitute from about 10% by weight to about 80% by weight of the molecule.

Also useful nonionic surfactants include the condensation products of one mole of alkyl phenol wherein the alkyl constituent, contains from about 8 to about 18 carbon atoms with from about 3 to about 50 moles of ethylene oxide. The alkyl group can, for example, be represented by diisobutylene, di-amyl, polymerized propylene, isoctyl, nonyl, and di-nonyl. Examples of commercial compounds of this chemistry are available on the market under the trade name IGEPAL® manufactured by Rhone-Poulenc and TRITON® manufactured by Union Carbide.

Likewise useful nonionic surfactants include condensation products of one mole of a saturated or unsaturated, straight or branched chain alcohol having from about 6 to about 24 carbon atoms with from about 3 to about 50 moles of ethylene oxide. The alcohol moiety can consist of mixtures of alcohols in the above delineated carbon range or it can consist of an alcohol having a specific number of carbon atoms within this range. Examples of like commercial surfactants are available under the trade name NEODOL® manufactured by Shell Chemical Co. and ALFONIC® manufactured by Vista Chemical Co. A preferred class of nonionic surfactants are nonyl phenol ethoxylates, or NPE.

Condensation products of one mole of saturated or unsaturated, straight or branched chain carboxylic acid having from about 8 to about 18 carbon atoms with from about 6 to about 50 moles of ethylene oxide. The acid moiety can consist of mixtures of acids in the above delineated carbon atoms range or it can consist of an acid having a specific number of carbon atoms within the range. Examples of commercial compounds of this chemistry are available on the market under the trade name NOPALCOL® manufactured by Henkel Corporation and LIPOPEG® manufactured by Lipo Chemicals, Inc. In addition to ethoxylated carboxylic acids, commonly called polyethylene glycol esters, other alkanoic acid esters formed by reaction with glycerides, glycerin, and polyhydric (saccharide or sorbitan/sorbitol) alcohols have application in this invention. All of these ester moieties have one or more reactive hydrogen sites on their molecule which can undergo further acylation or ethylene oxide (alkoxide) addition to control the hydrophilicity of these substances.

Semi-polar nonionic surfactants include water soluble amine oxides containing one alkyl moiety of from about 10 to 18 carbon atoms and two moieties selected from the group of alkyl and hydroxyalkyl moieties of from about 1 to about 3 carbon atoms; water soluble phosphine oxides containing one alkyl moiety of about 10 to 18 carbon atoms and two moieties selected from the group consisting of alkyl groups and hydroxyalkyl groups containing from about 1 to 3 carbon atoms; and water soluble sulfoxides containing one alkyl moiety of from about 10 to 18 carbon atoms and a moiety selected from the group consisting of alkyl and hydroxylalkyl moieties of from about 1 to 3 carbon atoms. Nonionic surfactants are of the formula $R^1 (OC_2H_4)_n OH$, wherein $R^1$ is a $C_6$-$C_{16}$ alkyl group and n is from 3 to about 80 can be used. Condensation products of $C_6$-$C_{15}$ alcohols with from about 5 to about 20 moles of ethylene oxide per mole of alcohol, e.g., $C_{12}$-$C_{14}$ alcohol condensed with about 6.5 moles of ethylene oxide per mole of alcohol.

Amphoteric surfactants include derivatives of aliphatic or aliphatic derivatives of heterocyclic secondary and tertiary amines in which the aliphatic moiety can be straight chain or branched and wherein one of the aliphatic substituents contain from about 8 to 18 carbon atoms and at least one aliphatic substituent contains an anionic water solubilizing group.

Cationic surfactants can also be included in the present detergent granules. Cationic surfactants include a wide variety of compounds characterized by one or more organic hydrophobic groups and a quaternary nitrogen carrying the positive charge. Pentavalent nitrogen ring compounds are also considered quaternary nitrogen compounds. Halides, methyl sulfate and hydroxide are suitable. Tertiary amines can have characteristics similar to cationic surfactants at washing solution pH values less than about 8.5. A more complete disclosure of these and other cationic surfactants useful herein can be found in U.S. Pat. No. 4,228,044, Cambre, issued Oct. 14, 1980, incorporated herein by reference.

Useful cationic surfactants also include those described in U.S. Pat. No. 4,222,905, Cockrell, issued Sep. 16, 1980, and in U.S. Pat. No. 4,239,659, Murphy, issued Dec. 16, 1980, both incorporated herein by reference.

Alkalinity Source

A source of alkalinity is needed to control the pH of the use detergent solution. The alkalinity source is selected from the group consisting of alkali metal hydroxide, such a sodium hydroxide, potassium hydroxide or mixtures thereof; an alkali metal silicate such as sodium metasilicate may also be used. The preferred source, which is the most cost-effective, is commercially available sodium hydroxide which can be obtained in aqueous solutions in a concentration of about 50 wt-% and in a variety of solid forms in varying particle sizes. The sodium hydroxide can be employed in the invention in either liquid or solid form or a mixture of both. Other sources of alkalinity are useful but not limited to the following: alkali metal carbonates, alkali metal bicarbonates, alkali metal sesquicarbonates, alkali metal borates and alkali metal silicate. The carbonate and borate forms are typically used in place of the alkali metal hydroxide when a lower pH is desired.

Other Ingredients

Other ingredients suitable for inclusion in a granular textile detergent, such as a bleach or other additives can be added to the present compositions. These include detergency builders, suds boosters or suds suppressers, anti-tarnish and anticorrosion agents, soil suspending agents, soil release agents, germicides, pH adjusting agents, non-builder alkalinity sources, chelating agents, smectite clays, enzymes, enzyme-stabilizing agents and perfumes. Such ingredients are described in U.S. Pat. No. 3,936,537, incorporated herein by reference.

Builders (or sequestrants) are employed to sequester hardness ions and to help adjust the pH of the laundering liquor. Such builders can be employed in concentrations up to about 85% by weight, preferably from about 0.5% to about 50% by weight, most preferably from about 10% to about 30% by weight, of the compositions herein to provide their builder and pH-controlling functions. The builders herein include any of the conventional inorganic and organic water soluble builder salts. Such builders can be, for example, water soluble salts of phosphates including tripolyphosphates, pyrophosphates, orthophosphates, higher polyphosphates, other carbonates, silicates, and organic polycarboxylates. Specific preferred examples of inorganic phosphate builders include sodium and potassium tripolyphosphates and pyrophosphates. Nonphosphorus-containing materials can also be selected for use herein as builders.

Specific examples of non-phosphorus, inorganic detergent builder ingredients include water soluble bicarbonate, and silicate salts using alkali metals, e.g., sodium and potassium. Water soluble, organic builders are also useful herein. For example, the alkali-metal polycarboxylates are useful in the present compositions. Specific examples of the polycarboxylate builder salts include sodium and potassium salts of ethylenediaminetetraacetic acid, nitrilotriacetic acid, oxydisuccinic acid, mellitic acid, benzene polycarboxylic acid, polyacrylic acid, and polymaleic acid. Other desirable polycarboxylate builders are the builders set forth in U.S. Pat. No. 3,308,067, incorporated herein by reference. Examples of such materials include the water soluble salts of homo- and copolymers of aliphatic carboxylic acids such as maleic acid, itaconic acid, mesaconic acid, fumaric acid, aconitic acid, citraconic acid, and methylenemalonic acid.

Other suitable polymeric polycarboxylates are the polyacetal carboxylates described in U.S. Pat. Nos. 4,144,226 and 4,246,495, both incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization alkaline solution, converted to the corresponding salt, and added to a surfactant.

Bleaching agents and activators useful herein are also described in U.S. Pat. Nos. 4,412,934, 4,483,781, 4,634,551, and 4,909,953, all of which are incorporated herein by reference. Chelating agents are also described in U.S. Pat. No. 4,663,071, incorporated herein by reference. Suds modifiers are also optional ingredients and are described in U.S. Pat. Nos. 3,933,672, and 4,136,045, both incorporated herein by reference.

The compositions for the alkaline wash step may contain one or more additional detergent components selected from additional surfactants, additional bleaches, bleach catalysts, alkalinity systems, builders, organic polymeric compounds, additional enzymes, suds suppressers, lime soap dispersants, soil suspension and anti-redeposition agents and corrosion inhibitors.

Processing and/or Manufacturing of the Solid Sour Composition

In general, a sour composition using the components of the present invention can be created by combining a powder premix and a liquid premix. The powder and liquid premixes are then combined together to form the solid sour composition, which is then solidified by any of a number of means, preferably by pressing. Applicants have surprisingly found that a soil release polymer can be stably included in a solid form to provide a sour step that not only removes residual alkalinity, but also provides soil removal.

By the term "solid form", it is meant that the hardened composition will not flow and will substantially retain its shape under moderate stress or pressure or mere gravity. The degree of hardness of the solid composition may range from that of a fused solid product which is relatively dense and hard, for example, like concrete, to a consistency characterized as being a hardened paste. In addition, the term "solid" refers to the state of the sour composition under the expected conditions of storage and use of the solid sour composition. In general, it is expected that the solid composition will remain in solid form when exposed to temperatures of up to approximately 100° F. and particularly greater than approximately 120° F.

Although the sour composition is discussed as being formed into a solid product, the sour composition may also be provided in the form of a paste. When the concentrate is provided in the form of a paste, enough water is added to the sour composition such that complete solidification of the sour composition is precluded. In addition, dispersants and other components may be incorporated into the sour composition in order to maintain a desired distribution of components.

The present solid composition can be made by an advantageous method of pressing the solid composition. Specifically, in a forming process, the liquid and solid components are introduced into the final mixing system and are continuously mixed until the components form a substantially homogeneous semi-solid mixture in which the components are distributed throughout its mass. In an exemplary embodiment, the components are mixed in the mixing system for at least approximately 5 seconds. The mixture is then discharged from the mixing system into, or through, a die, press or other shaping means. The product is then packaged. In an exemplary embodiment, the solid formed composition begins to harden between approximately 1 minute and approximately 3 hours. Particularly, the formed composition begins to harden in between approximately 1 minute and approximately 2 hours. More particularly, the formed composition begins to harden in between approximately 1 minute and approximately 20 minutes.

Pressing can employ low pressures compared to conventional pressures used to form tablets or other conventional solid compositions. For example, in an embodiment, the present method employs a pressure on the solid of only less than or equal to about 1000 psi. In certain embodiments, the present method employs pressures of less than or equal to about 900 psi, less than or equal to about 800 psi, or less than or equal to about 700 psi. In certain embodiments, the present method can employ pressures as low as greater than or equal to about 1 psi, greater than or equal to about 2, greater than or equal to about 5 psi, or greater than or equal to about 10 psi. In certain embodiments, the present method can employ pressures of about 1 to about 1000 psi, about 2 to about 900 psi, about 5 psi to about 800 psi, or about 10 psi to about 700 psi.

The method of the present invention can produce a stable solid without employing a melt and solidification of the melt as in conventional casting. Forming a melt requires heating a composition to melt it. The heat can be applied externally or can be produced by a chemical exotherm (e.g., from mixing caustic (sodium hydroxide) and water). Heating a composition consumes energy. Handling a hot melt requires safety precautions and equipment. Further, solidification of a melt requires cooling the melt in a container to solidify the melt and form the cast solid. Cooling requires time and/or energy. In contrast, the present method can employ ambient temperature and humidity during solidification or curing of the present compositions. Caustic compositions made according to the present method produce only a slight temperature increase due to the exotherm. The solids of the present invention are held together not by solidification from a melt but by a binding agent produced in the admixed particles and that is effective for producing a stable solid.

The method of the present invention can produce a stable solid without extruding to compress the mixture through a die. Conventional processes for extruding a mixture through a die to produce a solid composition apply high pressures to a solid or paste to produce the extruded solid. In contrast, the present method employs pressures on the solid of only less than or equal to about 1000 psi.

While the invention advantageously may be formed to solid by pressing, other methods of solid formation may also be used such as extrusion, cast molding and the like.

In an exemplary embodiment, a single- or twin-screw extruder may be used to combine and mix one or more components agents at high shear to form a homogeneous mixture. In some embodiments, the processing temperature is at or below the melting temperature of the components. The processed mixture may be dispensed from the mixer by pressing, forming, extruding or other suitable means, whereupon the composition hardens to a solid form. The structure of the matrix may be characterized according to its hardness, melting point, material distribution, crystal structure, and other like properties according to known methods in the art. Generally, a solid composition processed according to the method of the invention is substantially homogeneous with regard to the distribution of ingredients throughout its mass and is dimensionally stable.

The resulting solid composition may take forms including, but not limited to: an extruded, molded or formed solid pellet, block, tablet, powder, granule, flake; or the formed solid can thereafter be ground or formed into a powder, granule, or flake. In an exemplary embodiment, extruded pellet materials formed have a weight of between approximately 50 grams and approximately 250 grams, extruded solids have a weight of approximately 100 grams or greater, and solid blocks formed have a mass of between approximately 1 and approximately 10 kilograms. The solid compositions provide for a stabilized source of functional materials. In a preferred embodiment, the solid composition may be dissolved, for example, in an aqueous or other medium, to create a concentrated and/or use solution. The solution may be directed to a storage reservoir for later use and/or dilution, or may be applied directly to a point of use.

In certain embodiments, the solid composition is provided in the form of a unit dose. A unit dose refers to a solid composition unit sized so that the entire unit is used during a single washing cycle. When the solid cleaning composition is provided as a unit dose, it can have a mass of about 1 g to about 50 g. In other embodiments, the composition can be a solid, a pellet, or a tablet having a size of about 50 g to 250 g, of about 100 g or greater, or about 40 g to about 11,000 g.

In other embodiments, the solid composition is provided in the form of a multiple-use solid, such as, a block or a plurality of pellets, and can be repeatedly used to generate aqueous pre-soak compositions for multiple washing cycles. In certain embodiments, the solid composition is provided as a solid having a mass of about 5 g to 10 kg. In certain embodiments, a multiple-use form of the solid composition has a mass of about 1 to 10 kg. In further embodiments, a multiple-use form of the solid composition has a mass of about 5 kg to about 8 kg. In other embodiments, a multiple-use form of the solid composition has a mass of about 5 g to about 1 kg, or about 5 g and to 500 g.

Packaging System

The solid composition can be, but is not necessarily, incorporated into a packaging system or receptacle. The packaging receptacle or container may be rigid or flexible, and include any material suitable for containing the compositions produced, as for example glass, metal, plastic film or sheet, cardboard, cardboard composites, paper, or the like. The sour compositions may be allowed to solidify in the packaging or may be packaged after formation of the solids in commonly available packaging and sent to distribution center before shipment to the consumer.

For solids, advantageously, in at least some embodiments, since the pre-soak composition is processed at or near ambient temperatures, the temperature of the processed mixture is low enough so that the mixture may be cast or extruded directly into the container or other packaging system without structurally damaging the material. As a result, a wider variety of materials may be used to manufacture the container than those used for compositions that processed and dispensed under molten conditions. In some embodiments, the packaging used to contain the sour composition is manufactured from a flexible, easy opening film material.

Dispensing/Use of the Sour Composition

The sour composition can be dispensed as a concentrate or as a use solution. In addition, the sour composition concentrate can be provided in a solid form or in a liquid form. In general, it is expected that the concentrate will be diluted with water to provide the use solution that is then supplied to the surface of a substrate. In some embodiments, the aqueous use solution may contain about 2,000 parts per million (ppm) or less active materials, or about 1,000 ppm or less active material, or in the range of about 10 ppm to about 500 ppm of active materials, or in the range of about 10 to about 300 ppm, or in the range of about 10 to 200 ppm.

The use solution can be applied to the substrate during a presoak application, for example, in a warewashing machine, a car wash application, institutional healthcare surface cleaning or the like. In some embodiments, formation of a use solution can occur from a presoak agent installed in a cleaning machine, for example onto a dish rack. The presoak agent can be diluted and dispensed from a dispenser mounted on or in the machine or from a separate dispenser that is mounted separately but cooperatively with the dish machine.

In other example embodiments, solid products may be conveniently dispensed by inserting a solid material in a container or with no enclosure into a spray-type dispenser such as the volume SOL-ET controlled ECOTEMP Injection Cylinder system manufactured by Ecolab Inc., St. Paul, Minn. Such a dispenser cooperates with a washing machine. When demanded by the machine, the dispenser directs water onto the solid block of agent which effectively dissolves a portion of the block creating a concentrated aqueous pre-soak solution which is then fed directly into the water forming the aqueous pre-soak. The aqueous pre-soak is then contacted with the surfaces to affect a sour composition. This dispenser and other similar dispensers are capable of controlling the effective concentration of the active portion in the aqueous composition by measuring the volume of material dispensed, the actual concentration of the material in the water (an electrolyte measured with an electrode) or by measuring the time of the spray on the solid block.

The above description provides a basis for understanding the broad meets and bounds of the invention. The following examples and test data provide an understanding of certain specific embodiments of the invention. These examples are not meant to limit the scope of the invention. Unless otherwise noted, all parts, percentages, and ratios reported in the following examples are on a weight basis, and all reagents used in the examples were obtained, or are available, from the chemical suppliers described below, or may be synthesized by conventional techniques.

Exemplary Compositions of the Invention

Examples of useful ranges of components for the solid sour composition of the invention include those provided in the following table, with water making up any remainder:

| Component | Weight percent | Preferred Weight percent | More Preferred Weight percent |
|---|---|---|---|
| Acid source | 10-99 | 15-95 | 20-90 |
| Solidification Aid/ Hardening agent | 0-50 | 0.5-25 | 1-15 |
| Soil Release polymer | 0.1-25 | 0.5-20 | 1-15 |
| Optional fabric softener | 0-20 | 0-10 | 0-5 |

The invention has been shown and described herein in what is considered to be the most practical and preferred embodiment. The applicant recognizes, however, that departures may be made therefrom within the scope of the invention and that obvious modifications will occur to a person skilled in the art. The examples which follow are intended for purposes of illustration only and are not intended to limit the scope of the invention. All references cited herein are hereby incorporated in their entirety by reference.

Examples

The main wash step of a typical institutional or industrial laundry cycle has a use solution with both high surfactant and high alkalinity (~pH 11 or higher). Conversely, the final rinse step wash liquor is less reactive as the pH is near neutral and any surfactant has been rinsed away. Therefore, it is desirable to use a soil release polymer, which is typically polyester based, but these are hydrolyzed by highly alkaline or acidic pH, in the final rinse step.

Applicants sought to develop a soil release polymer into a sour product which is used on polyester and polyester blends of linen. Unfortunately this class of polymer is not stable in a liquid sour because they are polyester based and react with the acid or oxidizer. Surprisingly, Applicants found that soil release polymers can be made to be stable in a solid sour formulation.

According to the invention, applicants have developed a physically and chemically stable, i.e. non-hydrolizing, solid composition containing a soil release polymer and an acidulant. The sour step thus accomplishes both stain removal and residual alkalinity removal. A novel method of using a soil release polymer and an acidulant together in the same rinse of a laundry wash process. The invention also includes a process of preparing a solid composition with a soil release polymer and acidulant that is physically stable, even during aqueous dispensing, i.e. non-slumping and non-weeping. The solid could be formed through a melt, cast, or pressed process.

Texcare SRN 300 is a nonionic polyester soil release polymer available from Clariant Inc., Switzerland Accusoft 550 is a methyl bis(tallowamido ethyl)-2-hydroxyethyl ammonium methyl sulfate available from Stepan, Inc.

Sokalan DCS is a dicarboxylic acid ($C_4$-$C_6$) mixture available from BASF.

Carbowax MPEG 550 is methoxypolyethylene glycol (MPEG PEG 10) available from Dow Chemical.

TABLE 1

Solid laundry sour containing a soil release polymer

| Chemical Name | Tradename | Solid Laundry Sour (%) |
|---|---|---|
| Quaternary ammonium sulfate fabric softener | Accosoft 550 | 0-5 |
| Methoxypolethylene Glycol | Carbowax MPEG 550 | 1-15 |
| Polyethylene Glycol MW 8000 | | |
| Dicarboxylic acid mixture | Sokalan DCS | 40-90 |
| Anhydrous Sodium Bisulfate Granular | | |
| Soil Release Polymer | Texcare SRN 300 | 1-15 |
| | Total | 100 |

Mix Instructions:

The raw materials were added to a steam jacket mixer in the order listed in Table 1. Prior to the addition of the first item, the jacket was heated to 65° C. The mix temperature was maintained at 65° C. until the addition of the soil release polymer. Prior to the addition of the soil release polymer, the batch was cooled to 50° C. and held below that temperature until completion of the mix.

We evaluated the use of soil release polymers in a wash at the two steps where traditional laundry products are added: the main wash and the final rinse step.

A commercially available alkaline detergent was used in the test below over a series of wash cycles with a soil release polymer added separately in either the main wash or final rinse step. At the conclusion of all of the wash cycles, 100% polyester swatches removed after cycles 0, 1, and 3 were soiled with dirty motor oil. After wicking overnight on a flat surface they were washed with the alkaline detergent, without soil release polymer, to determine how the removal of dirty motor oil changed with application of soil release polymer.

TABLE 2

Percent soil removal of dirty motor oil after alkaline detergent washes with a soil release polymer added separately in the main wash or final rinse step

| | % Soil Removal | |
|---|---|---|
| Cycle # | Main Wash | Rinse Step |
| 0 | 20.42 | 20.42 |
| 1 | 21.23 | 37.4 |
| 3 | 37.9 | 63.15 |

In both examples above, the percent removal of dirty motor oil increased with a greater number of wash cycles indicating buildup of the soil release polymer. The removal was significantly higher after cycles 1 and 3 with rinse step application, indicating greater buildup of the soil release polymer. In the main wash step, the use solution has both high surfactant and high alkalinity (pH 11) which can chemically degrade the polymer as well as remove it from the surface. The wash liquor of the final rinse step is milder, allowing greater buildup of the polymer and therefore better performance. Based on this data, a soil release polymer provides superior performance in a commercial laundry formula when used in the final rinse step.

A laundry sour is used in the finishing step of a wash process to neutralize alkalinity introduced by the basic detergent as well as the incoming water. Sours have a very low pH (<2) and may also contain an oxidizer. This is a harsh environment for a polyester based soil release polymer and makes chemical stability a challenge. We tested both liquid and solid sour products to determine which product form would allow for chemical stability of a soil release polymer.

The solid sour formulation (Table 1 above) was evaluated in comparison to two liquid sours containing a soil release polymer. The two liquid sours tested were commercially available with 2% soil release polymer formulated into each of them. The liquid and solid formulations were prepared 7 days prior to wash testing so the samples could age at 40° C. to provide accelerated aging conditions compared to room temperature. The sours were used over 7 consecutive wash cycles (with drying in between each cycle) in a 35 lb washer with 24 lb 100% polyester fill and 5 grain water. The chemistry was dosed equally in all three wash studies as described in the tables below.

TABLE 3

Chemistry dose for wash comparison of solid and liquid sours with soil release polymer

| Step | Chemistry | Dose (g) |
|---|---|---|
| Main Wash of All Examples | Commercial alkaline detergent | 95 |
| Final Rinse of Solid Sour Example | Solid Sour Containing Soil Release Polymer | 75 |
| Final Rinse of Liquid Sour 1 Example | Liquid Sour 1 with Soil Release Polymer | 75 |
| Final Rinse of Liquid Sour 2 Example | Liquid Sour 2 with Soil Release Polymer | 75 |

TABLE 4

Wash cycle used with sours containing soil release polymer

| Step | Description | Time |
|---|---|---|
| 1 | 60° C. Fill to Low Level | |
| 2 | Main Wash (60° C.) | 14:00 |
| 3 | Drain | |
| 4 | 55° C. Fill to High Level | |
| 5 | Wash (55° C.) | 2:00 |
| 6 | Drain | |
| 7 | 50° C. Fill to High Level | |
| 8 | Wash (50° C.) | 2:00 |
| 9 | Drain | |
| 10 | 45° C. Fill to High Level | |
| 11 | Wash (45° C.) | 2:00 |
| 12 | Drain | |
| 13 | 40° C. Fill to Low Level | |
| 14 | Final Rinse (40° C.) | 5:00 |
| 15 | Drain | |
| 16 | Spin | 4:00 |

The sours were added in the final rinse step at equal activity of polymer to determine if any difference in soil removal over the cycles appeared between the loads treated with the three different sours.

Unsoiled, 100% polyester swatches were put through the wash process. A total of four swatches were removed after the drying in cycles 0, 1, 3, 5, and 7. After all washes were complete all of the swatches from each cycle were soiled with 0.1 g of dirty motor oil. The stain was allowed to wick overnight on a flat surface and washed the following day using the same wash process described in Tables 3 and 4, except no sour was added. The percent of soil removal was calculated by measuring the reflectance of the soil on the swatches before and after wash on the spectrophotometer (ColorQuest XE, Hunter Associates Laboratory). The L* value is one of the color indices and is indicative of broad visible spectrum reflectance, where 100% is considered completely white. The % soil removal was calculated using formula 1.

$$\% \quad SR=((L^*_{Post\ wash}-L^*_{Prewash})/(96-L^*_{Prewash}))*100$$

Formula 1: Equation of % soil removal

TABLE 5

Percent soil removal of dirty motor oil after washes with a sour containing soil release polymer

| | % Soil Removal | | |
|---|---|---|---|
| Cycle # | Liquid Sour 1 | Liquid Sour 2 | Solid Sour |
| 0 | 25.22 | 25.22 | 25.22 |
| 3 | 24.21 | 27.51 | 32.83 |
| 5 | 25.54 | 29.92 | 38.77 |
| 7 | 24.41 | 32.29 | 44.10 |
| % Change in Removal (0 to 7) | −3% | 28% | 75% |

As shown in table 5, the % removal of dirty motor oil remains unchanged in the liquid sour 1 example even as the number of cycles increases. In the liquid sour 2 example, the % dirty motor oil removal does increase by 28% from the initial cycle to the final cycle. That increase is significantly lower than the increase in oil removal in the solid sour example. The % removal increases by 75% over the wash study in the Solid Sour example. In the two liquid sour examples, there was significant chemical degradation of the soil release polymer which led to lower buildup of polymer over the wash study. In the solid example, the polymer was able to buildup over the wash study leading to much greater removal.

While this data signifies that some of the soil release polymer was stable in the solid sour formulation, it was unclear whether all of the performance was maintained. The performance of a soil release polymer formulated into a similar solid sour was compared to the performance of the same polymer dosed separately from the solid sour into the wash wheel, i.e. not formulated into the solid sour. This was done to determine if the entirety of the polymer remained active in the solid sour, or if some of it degraded due to the acidity of the product.

The test was run in essentially the same conditions as the previous example. The solid sour with soil release polymer was again aged for 7 days at 40° C. to provide accelerated aging conditions. The same washer conditions were used for this wash process (35 lb washer, 24 lb polyester linen, 5 grain water, wash cycle from table 5), however it was done over 5 wash cycles, instead of 7, with slightly different chemistry addition (table 6).

TABLE 6

Chemistry dose for wash comparison of formulated solid sour with soil release polymer and separate addition of solid sour and soil release polymer

| Step | Chemistry | Dose (g) |
|---|---|---|
| Main Wash of Both Examples | Alkaline detergent | 95 |
| Final Rinse Step in Formulated Example | Solid Sour Containing Soil Release Polymer | 53 |
| Final Rinse Step of Separate Example | Solid sour + Soil Release Polymer added separately (at equal active polymer level to the previous example) | 53 |

The soil release polymer was added at equal active in both the formulated and separate addition examples. If there was a disparity in performance between the two conditions, it had to be due to degradation of soil release polymer in the solid sour formula.

After the 5 cycle test was done for both conditions, the 100% unsoiled polyester swatches that were removed after cycles 0, 1, 3, and 5 were soiled with 0.1 g of dirty motor oil and washed again using the same wash formula, except no sour or soil release polymer was added. The same calculation for analyzing percent removal over the wash study was used as the liquid vs. sour comparison.

TABLE 7

Percent soil removal of dirty motor oil after washes with a sour and soil release polymer either added as one formulated product, or separate stand alone products

| | % Soil Removal | |
|---|---|---|
| Cycle # | Formulated | Separate |
| 0 | 34.71 | 34.71 |
| 1 | 43.00 | 41.62 |
| 3 | 53.38 | 57.21 |
| 5 | 65.18 | 66.02 |

In both examples in table 7 the percent removal of dirty motor oil increases as the cycle number increases, indicating buildup of the soil release polymer. There is no statistical difference of the soil removal between the example with soil release polymer formulated into the solid sour and the two products added separately. This data indicates that there was no chemical degradation of the soil release polymer in the solid sour, despite the presence of acid in the formula. Surprisingly, a soil release polymer is fully stable in a solid sour formulation.

What is claimed is:

1. A cast, pressed or extruded solid laundry sour composition comprising:

from about 30 wt. % to about 90 wt. % of a $C_1$-$C_8$ carboxylic acid source;

from about 1 wt. % to about 15 wt. % of a polyethylene terephthalate or polyoxyethylene terephthalate soil release polymer;

from about 1 wt. % to about 15 wt. % of a solidification aid; and from 0 wt. % to about 20 wt. % of an ammonium quaternary fabric softener, wherein the composition has a pH of less than 2 about and a use composition pH of 4-6.5;

wherein the composition does not include a water soluble organic salt;

wherein the composition is substantially free of silicates; and wherein the composition is substantially free of phosphates.

2. The composition of claim 1 wherein said acid comprises a $C_1$-$C_8$ dicarboxylic acid.

3. The composition of claim 1 wherein said soil release polymer is a polyester.

4. The composition of claim 1 further comprising a fabric softener.

5. The composition of claim 1 wherein said solid is a tablet, a lozenge, a puck, a briquette, a brick, or a solid block.

6. The composition of claim 1 wherein said solid is a unit dose.

7. The composition of claim 1 further comprising an oxidizer.

8. A physically and chemically stable, non-hydrolyzing cast solid laundry sour composition comprising:

from about 30 wt. % to about 90 wt. % of a $C_1$-$C_8$ dicarboxylic acid;

from about 1 wt. % to about 15 wt. % of a polyethylene terephthalate or polyoxyethylene terephthalate polyester soil release polymer;

from about 3 wt. % to about 15 wt. % of a solidification aid; and from about 0.5 wt. % to about 5 wt. of a quaternary ammonium sulfate fabric softener;

wherein the composition does not include a water soluble organic salt;

wherein said composition is substantially free of silicates; and wherein said composition is substantially free of phosphates.

9. The composition of claim 2, further comprising an oxidizer.

* * * * *